US008568097B1

(12) United States Patent
Liang

(10) Patent No.: US 8,568,097 B1
(45) Date of Patent: Oct. 29, 2013

(54) TURBINE BLADE WITH CORE PRINT-OUT HOLE

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 701 days.

(21) Appl. No.: 12/885,617

(22) Filed: Sep. 20, 2010

(51) Int. Cl.
*F01D 5/08* (2006.01)

(52) U.S. Cl.
USPC ..... 416/97 R

(58) Field of Classification Search
USPC ..... 415/115, 121.2, 121.3, 169.1, 169.2, 415/169.3; 416/97 R, 228, 235, 236 R
See application file for complete search history.

(56) References Cited

U.S. PATENT DOCUMENTS 4,940,388 A * 7/1990 Lilleker et al. ..... 416/97 R
5,062,768 A * 11/1991 Marriage ..... 416/97 R
7,695,243 B2 * 4/2010 Lee et al. ..... 415/121.1

* cited by examiner

*Primary Examiner* — Edward Look
*Assistant Examiner* — Aaron R Eastman
(74) *Attorney, Agent, or Firm* — John Ryznic

(57) ABSTRACT

A turbine rotor blade with a 5-pass serpentine aft flowing cooling circuit having first and second tip turns under the blade tip floor, and a core print-out hole having two inlets and one common outlet that discharges cooling air from the two tip turns out from the blade tip. A first inlet of the core print-out hole opens into the first tip turn, and a second inlet of the core print-out hole opens into the second tip turn. The core print-out hole is formed by a T-shaped ceramic core connector that also positions the core or cores used to cast the serpentine flow cooling circuit within the blade.

3 Claims, 4 Drawing Sheets

TURBINE BLADE WITH CORE PRINT-OUT HOLE

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine rotor blade with a serpentine flow cooling circuit.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

A turbine rotor blade is cooled using a serpentine flow cooling circuit in which cooling air flows upward to the blade tip region and then turns 180 degrees and flows toward the platform region in order to extend the length of the cooling air path and provide increased cooling effectiveness. FIG. 1 shows a 5-pass aft flowing serpentine blade cooling design with a first leg 11 located adjacent to a leading edge region cooling circuit and the remaining four legs extending toward the trailing edge region. The first leg 11 turns into the second leg 12 at the blade tip region to also provide impingement cooling to an underside of the blade tip. The third leg 13 also turns into the fourth leg at the blade tip region. The first leg 11 supplies a showerhead arrangement of film cooling holes and gill holes to provide cooling to this region. The fifth leg 15 of the 5-pass serpentine flow circuit provide cooling air for a trailing edge region cooling circuit that includes double impingement followed by discharge through exit slots arranged along the trailing edge of the blade. FIG. 2 shows a cross section view of the 5-pass serpentine flow cooling circuit and FIG. 3 shows a flow diagram of the 5-pass serpentine flow cooling circuit of FIG. 1.

FIG. 1 also shows two core print-out holes 17 at the two turns of the 5-pass serpentine flow cooling circuit that function as dirt holes that purge particulates such as small dirt particles from the cooling air using centrifugal force. Any dirt particulates within the cooling air flow will fall out of the turn by passing straight through the dirt hole 17 instead of making the 180 degree turn into the next down flow channel of the serpentine circuit. Any dirt particulates that are not discharged from the first dirt hole 17 will theoretically pass out from the second dirt holes at the end of the third leg 13. Use of the dirt holes 17 in the serpentine flow circuit will discharge some of the cooling air from the blade. The size of the dirt holes depends upon the size of the blade. for a large frame heavy duty industrial gas turbine (IGT) engine, the dirt hole size can be in a range of 2-4 mm. this size dirt holes results in 0.1% to 0.2% of the total engine flow being discharged through each of the dirt holes 17.

BRIEF SUMMARY OF THE INVENTION

A turbine rotor blade with a serpentine flow cooling circuit having tip turns in which adjacent legs of the serpentine flow circuit make a 180 degree turn just below the tip floor. A T-shaped ceramic core connector is used in the casting process to form the blade in order to position the mid-chord section serpentine ceramic cores. The T-shaped ceramic core includes two entrance cores and one exit outlet core all formed as a single piece. The entrance core connects to both tip turns of the 5-pass serpentine shaped core. The size of the entrance core and the exit core depends upon the size of the blade and an internal pressure in the tip turns. Since the exit core print-out hole is less than the prior art manufacture process, a reduction of the cooling air flow used for the tip hole is achieved. In addition, a common exit core print-out hole is shared with both entrance cores and therefore additional cooling air flow saving is obtained.

DETAILED DESCRIPTION OF THE INVENTION

Figure 1:
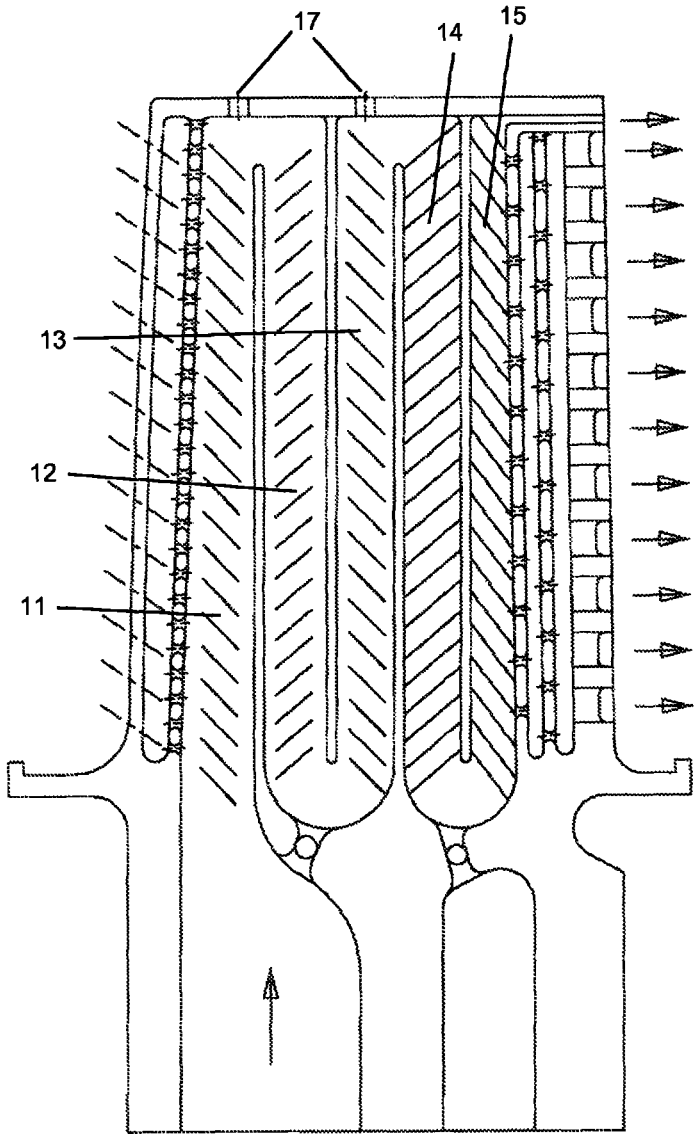
FIG. 1 shows a cross section side view of a turbine rotor blade with a 5-pass aft flowing serpentine blade cooling circuit.
Figure 2:
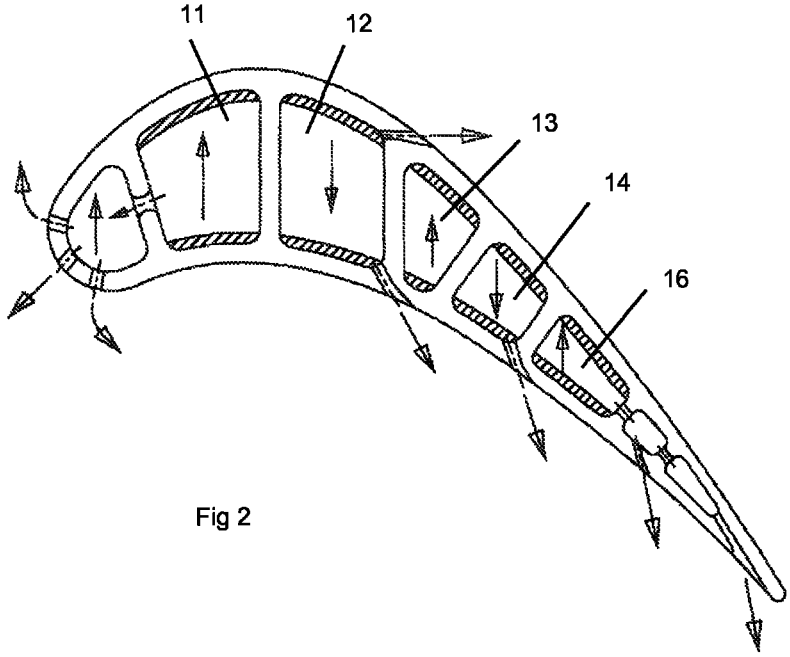
FIG. 2 shows a cross section view along the spanwise direction of the 5-pass aft flowing serpentine blade cooling circuit of FIG. 1.
Figure 3:
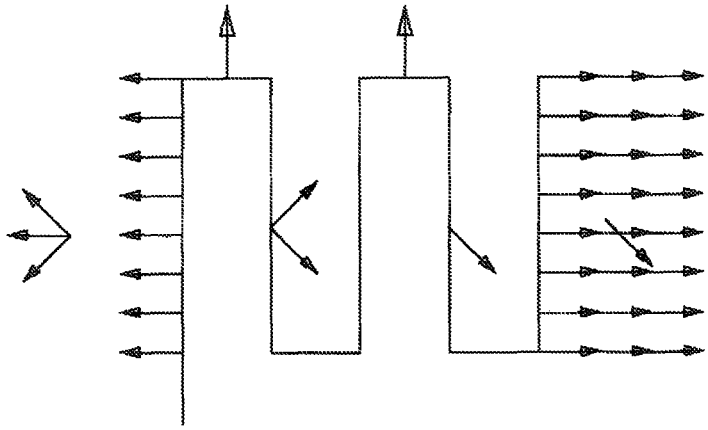
FIG. 3 shows a flow diagram of the 5-pass aft flowing serpentine blade cooling circuit of FIG. 1.
Figure 4:
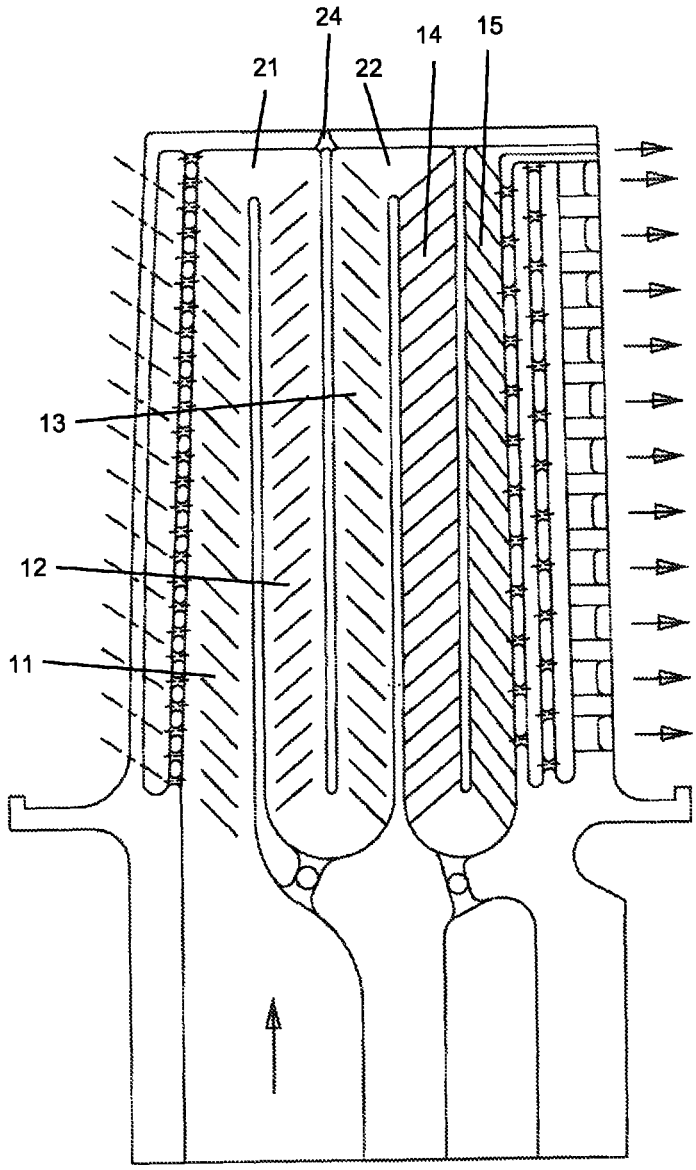
FIG. 4 shows a cross section side view of a turbine rotor blade with a 5-pass aft flowing serpentine blade cooling circuit and a core print-out hole in the blade tip.

A turbine rotor blade, such as a blade used in a large frame heavy duty industrial gas turbine engine, with a 5-pass aft flowing serpentine blade cooling circuit. The blade serpentine cooling circuit is shown in FIG. 4 and includes a first leg 11 located adjacent to the leading edge region, followed by a second leg 12, a third leg 13, and fourth leg 14 and then a fifth leg 15 located adjacent to the trailing edge region. A first blade tip turn 21 is located between the first 11 and second legs 12, and a second tip turn 22 is located between the third 13 and fourth 14 legs. Each of the tip turns 21 and 22 includes a row of trenches that extend from the pressure side wall to the suction side wall of the channel and form dirt entrapment trenches.

A core print-out hole 24 includes two inlet holes and one common outlet hole that opens onto the blade tip outer surface to discharge cooling air from the blade tip. One of the inlet holes is connected to the first tip turn 21 and the other of the inlet holes is connected to the second tip turn 22. The two inlet holes merge into the common outlet hole.

Figure 5:
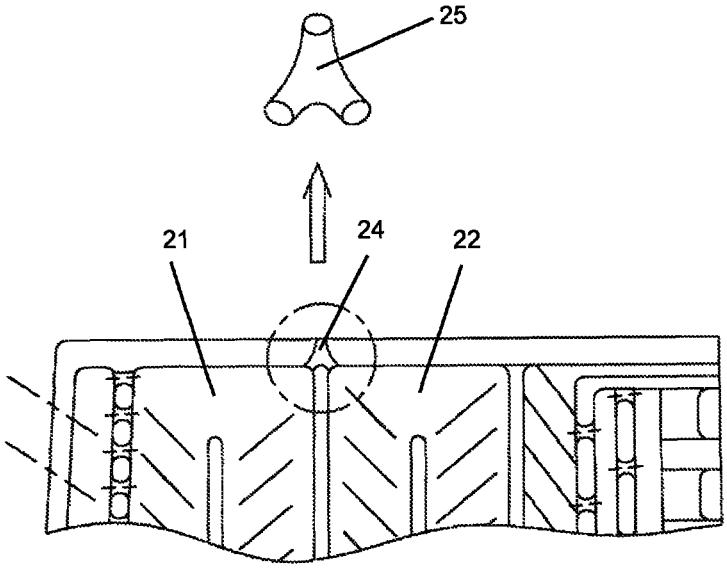
FIG. 5 shows a detailed view of one of the blade tip with the core print-out hole and the ceramic T-shaped ceramic core connector of the present invention.

FIG. 5 shows a detailed view of the blade tip with the first and second tip turns 21 and 22 and the core print-out hole 24. a T-shaped ceramic core connector 25 is shown above the core print-out hole 24 and is used to cast the core print-out hole 24 during the casting process to form the blade. The core print-out hole 24 will discharge cooling air from the first and second tip turns 21 and 22 and out through the common outlet hole in the blade tip. Any dirt particles passing through the tip turns will be discharged as well. The T-shaped ceramic core connector 25 is used to position the ceramic core or cores that will be used to cast the serpentine flow cooling circuit within the blade. As seen in FIG. 5, the two tip turns have slightly curved wall surfaces that form a smooth flow surface for the cooling air. The first inlet hole of the core print-out 24 is located on the curved wall surface of the first tip turn at a location on the downstream side in the direction of the cooling air flow which is on an extension of a rib that separates the second leg 12 from the third leg 13 of the 5-pass serpentine circuit. The second inlet hole is located on the upstream side of the curved wall in the second tip turn 22.

I claim the following:

1. A turbine rotor blade comprising:

an airfoil having a leading edge region and a trailing edge region, and a pressure side wall and a suction side wall both extending between the leading edge region and the trailing edge region;

a five pass serpentine flow cooling circuit having a first upward flowing leg and a first downward flowing leg with a first tip turn connecting the first upward flowing leg and the first downward flowing leg, a second upward flowing leg and a second downward flowing leg with a second tip turn connecting the second upward flowing leg and the second downward flowing leg; and, a core print-out hole formed in the blade tip and having two inlets and one common outlet where one inlet is connected to the first tip turn and the second inlet is connected to the second tip turn.

2. The turbine rotor blade of claim 1, and further comprising:

the first inlet of the core print-out hole is located on a downstream surface of the first tip turn; and, the second inlet of the core print-out hole is located on an upstream surface of the second tip turn.

3. The turbine rotor blade of claim 1, and further comprising:

the serpentine flow cooling circuit is a 5-pass serpentine flow cooling circuit.

* * * * *